US009056461B2

(12) United States Patent
Sakurai et al.

(10) Patent No.: US 9,056,461 B2
(45) Date of Patent: Jun. 16, 2015

(54) METHOD FOR DRIVING LIQUID DISCHARGE HEAD, LIQUID DISCHARGE HEAD, AND LIQUID DISCHARGE APPARATUS

(75) Inventors: Makoto Sakurai, Kawasaki (JP); Hirokazu Komuro, Yokohama (JP); Ichiro Saito, Yokohama (JP); Yuzuru Ishida, Yokohama (JP); Takeru Yasuda, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 79 days.

(21) Appl. No.: 13/992,213

(22) PCT Filed: Nov. 18, 2011

(86) PCT No.: PCT/JP2011/006429

§ 371 (c)(1),
(2), (4) Date: Jun. 6, 2013

(87) PCT Pub. No.: WO2012/077283

PCT Pub. Date: Jun. 14, 2012

(65) Prior Publication Data

US 2013/0257995 A1 Oct. 3, 2013

(30) Foreign Application Priority Data

Dec. 9, 2010 (JP) ..... 2010-275138

(51) Int. Cl.
*B41J 2/05* (2006.01)
*B41J 2/045* (2006.01)
*B41J 2/14* (2006.01)

(52) U.S. Cl.
CPC *B41J 2/05* (2013.01); *B41J 2/0455* (2013.01); *B41J 2/0458* (2013.01); *B41J 2/14129* (2013.01); *B41J 2002/14387* (2013.01)

(58) Field of Classification Search
CPC ..... B41J 2/1631; B41J 2/162
USPC ..... 347/56
See application file for complete search history.

(56) References Cited

U.S. PATENT DOCUMENTS 4,626,875 A * 12/1986 Hara et al. ..... 347/56
5,491,505 A * 2/1996 Suzuki et al. ..... 347/203

(Continued)

FOREIGN PATENT DOCUMENTS

EP 0995600 A2 4/2000
EP 1312477 A1 5/2003

(Continued)

*Primary Examiner* — Matthew Luu
*Assistant Examiner* — Patrick King
(74) *Attorney, Agent, or Firm* — Canon USA Inc. IP Division

(57) ABSTRACT

A liquid discharge apparatus includes: a liquid discharge head which includes; a discharge port to discharge a liquid; and a substrate including: an energy generating element for generating thermal energy to discharge the liquid from the liquid discharge port; a pair of electrodes connected to the energy generating element for driving thereof; an insulating layer of an insulating material provided to cover the energy generating element; and a metal layer of a metal material provided corresponding to the energy generating element to cover the insulating layer; and a driver unit which sets a first potential of one of the pair of electrodes substantially equal to the potential of the liquid and a second potential of the other one of the pair of electrodes lower than the first potential to drive the energy generating element.

9 Claims, 6 Drawing Sheets

(56) References Cited

U.S. PATENT DOCUMENTS

| | | | | |
|---|---|---|---|---|
| 5,600,355 | A * | 2/1997 | Wada | 347/55 |
| 5,850,242 | A * | 12/1998 | Asaba | 347/59 |
| 6,056,392 | A * | 5/2000 | Matsumoto et al. | 347/59 |
| 6,361,150 | B1 | 3/2002 | Schulte et al. | |
| 6,454,379 | B1 * | 9/2002 | Taneya et al. | 347/19 |
| 6,474,769 | B1 * | 11/2002 | Imanaka et al. | 347/19 |
| 6,890,048 | B2 * | 5/2005 | Hirayama | 347/12 |
| 6,997,546 | B2 * | 2/2006 | Imanaka et al. | 347/59 |
| 7,028,402 | B2 * | 4/2006 | Miyamoto et al. | 29/890.1 |
| 7,059,710 | B2 * | 6/2006 | Ishikawa | 347/68 |
| 7,673,973 | B2 * | 3/2010 | Edelen et al. | 347/59 |
| 2002/0126181 | A1 * | 9/2002 | Miyamoto et al. | 347/63 |
| 2004/0257400 | A1 * | 12/2004 | Silverbrook | 347/40 |
| 2006/0125872 | A1 | 6/2006 | Sakurai | |
| 2007/0146428 | A1 | 6/2007 | Sakai | |
| 2008/0122896 | A1 * | 5/2008 | Stephenson, III | 347/50 |
| 2009/0027450 | A1 | 1/2009 | Park | |

FOREIGN PATENT DOCUMENTS

| | | | |
|---|---|---|---|
| EP | 1661706 | A1 | 5/2006 |
| EP | 2186641 | A1 | 5/2010 |
| JP | S61-255866 | A | 11/1986 |
| JP | S63-005950 | A | 1/1988 |
| JP | H02-052746 | A | 2/1990 |
| JP | 2002-067325 | A | 3/2002 |
| JP | 2003-19799 | A | 1/2003 |
| JP | 2004-50646 | A | 2/2004 |
| JP | 2004-055844 | A | 2/2004 |
| JP | 2006-205572 | A | 8/2006 |
| JP | 2007-245405 | A | 9/2007 |

* cited by examiner

METHOD FOR DRIVING LIQUID DISCHARGE HEAD, LIQUID DISCHARGE HEAD, AND LIQUID DISCHARGE APPARATUS

TECHNICAL FIELD

The present invention relates to a method for driving a liquid discharge head, a liquid discharge head, and a liquid discharge apparatus.

BACKGROUND ART

A typical liquid discharge head mounted in a liquid discharge apparatus represented by a thermal type ink jet recording device has a plurality of energy generating elements which generate thermal energy used to discharge a liquid.

As disclosed in PTL 1, the energy generating element is formed in such a way that a layer of a heat generating resistive material which generates heat by electrical power supply and a pair of electrodes to supply an electrical power to this layer are provided on a substrate formed of silicon, and an insulating layer of an insulating material is further provided for covering. In order to protect the insulating layer from cavitation impact generated when a liquid or the like is discharged, a metal layer formed form a metal material is provided on the surface of the insulating layer, so that the durability thereof is improved. In addition, when the insulating layer has a hole (crack), since an electrochemical reaction occurs between the metal layer and the liquid to deteriorate the metal layer, degradation in durability and/or and dissolution of the metal layer may occur. Hence, inspection of insulation properties between the energy generating element and the metal layer is performed at a manufacturing stage. The metal layer described above has a belt shape and is commonly provided to protect a plurality of energy generating elements, and the inspection of insulation properties is conducted using an inspection terminal connected to the metal layer and an inspection terminal commonly connected to the plurality of energy generating elements. According to this method, the inspection of insulation properties of the insulating layer can be collectively performed for the plurality of energy generating elements.

CITATION LIST

Patent Literature

PTL 1: Japanese Patent Laid-Open No. 2004-50646

However, even if the insulating layer is inspected in a manufacturing process, when a crack or the like is formed in the insulating layer by a physical impact, such as cavitation, generated when air bubbles are defoamed in a recording operation, the energy generating element and the metal layer may be short-circuited in some cases. In general, the liquid discharge head as described above is driven by applying a ground potential (GND potential) which is substantially 0 V and a power supply potential (VH potential) higher than the ground potential to a pair of electrodes. Since a supply port used to supply a liquid in this case is formed so as to penetrate the substrate connected to the GND potential, the liquid is also at the GND potential.

Since the liquid, such as ink, generally contains a large amount of an electrolyte and has electrical conductivity, if the VH potential which is higher than a potential of the liquid at the GND potential is applied to the energy generating element, the metal layer is at a positive potential with respect to the potential of the liquid. For example, iridium or ruthenium is used as the metal layer, and the relationship between the potential and pH is shown in FIG. 6A or 6B.

As apparent from the above relationship, if the metal layer is at a positive potential and is also in contact with a liquid having a pH of 7 to 10, depending on a material for the metal layer, the metal layer may be dissolved out in some cases. That is, in the structure disclosed in PTL 1 in which the plurality of energy generating elements is commonly covered with the belt-shaped metal layer, when one energy generating element is short-circuited, the metal layer covering the plurality of energy generating elements may be dissolved out in some cases. In addition, the thickness of the metal layer is decreased, and as a result, the durability thereof may be degraded. Furthermore, air bubbles generated during the dissolution of the metal layer will cover upper surfaces of the energy generating elements, and as a result, a normal recording operation may not be performed in some cases.

SUMMARY OF INVENTION

According to an aspect of the present invention, a liquid discharge apparatus comprises: a liquid discharge head which includes: a discharge port to discharge a liquid; and a substrate including: an energy generating element for generating thermal energy to discharge the liquid from the liquid discharge port; a pair of electrodes connected to the energy generating element for driving thereof; an insulating layer of an insulating material provided to cover the energy generating element; and a metal layer of a metal material provided corresponding to the energy generating element to cover the insulating layer; and a driver unit which sets a first potential of one of the pair of electrodes substantially equal to the potential of the liquid and a second potential of the other one of the pair of electrodes lower than the first potential to drive the energy generating element.

When the liquid discharge head is provided as described above, even if the energy generating element and the metal layer are short-circuited by a crack or the like formed in the insulating layer by physical damage, the metal layer covering the other energy generating elements is not at a positive potential with respect to the potential of the liquid, and hence, a reliable recording operation can be performed.

DESCRIPTION OF EMBODIMENTS

Figure 1A:
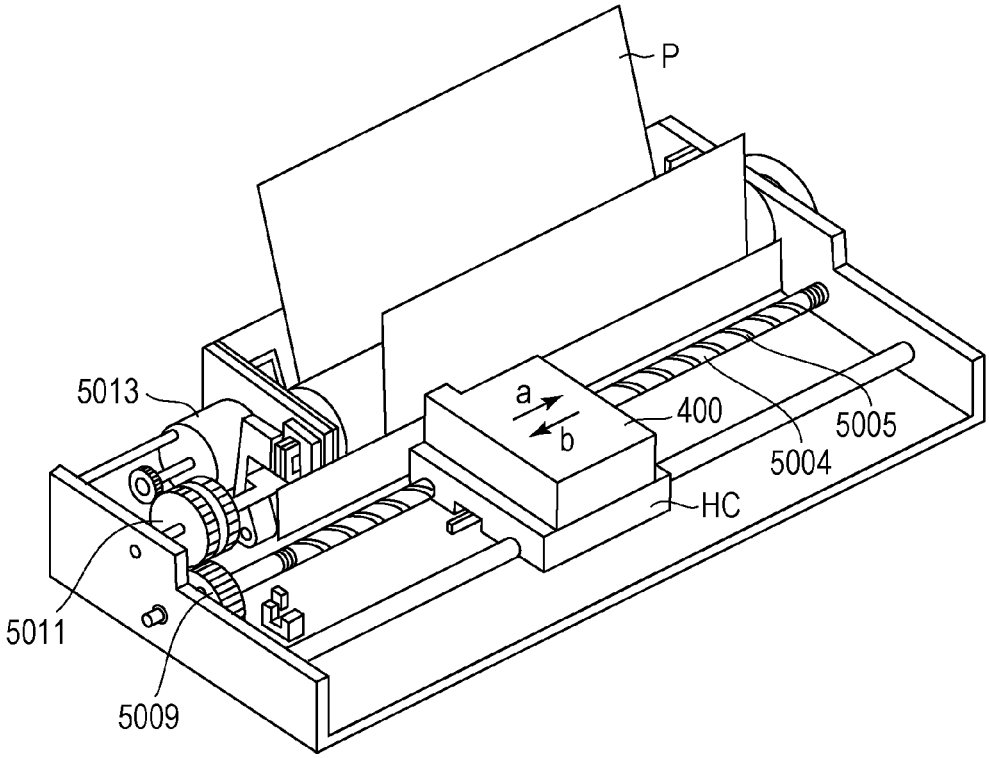
FIG. 1A is a schematic perspective view of a liquid discharge apparatus.

A liquid discharge head can be mounted in various devices, such as a printer, a copying machine, a facsimile having a communication system, and a word processor having a printer portion, and furthermore may also be mounted in an industrial recording apparatus integrally formed from various processing devices. In addition, when this liquid discharge head is used, recording can be performed on various recording media, such as paper, yarn, fiber, cloth, leather, metal, plastic, glass, wood, and ceramic.

The "recording" used in this specification not only indicates that an image, such as a letter or a figure, having a certain meaning is imparted on a recording medium but also indicates that an image, such as a pattern, having no meaning is imparted thereon.

Furthermore, in the present specification, the "liquid" should be construed to have a broad meaning, and when being applied on a recording medium, the liquid is a liquid which is used to form an image, a design, a pattern, or the like; to process a recording medium; or to perform a treatment of an ink or a recording medium. In this embodiment, the treatment of an ink or a recording medium includes, for example, treatments for improvement in fixability by solidification or insolubilization of a color material contained in an ink applied on a recording medium, improvement in recording quality or color development, and improvement in image durability. Furthermore, the "liquid" which is used for the liquid discharge apparatus of the present invention generally contains a large amount of an electrolyte and thereby has electrical conductivity.

Hereinafter, embodiments of the present invention will be described with reference to the drawings. In the following description, elements having the same function will be designated by the same reference numeral in the drawings.

A liquid discharge apparatus will be described.

FIG. 1A is a schematic view showing a liquid discharge apparatus which can mount a liquid discharge head according to the present invention. As shown in FIG. 1A, a lead screw 5004 is rotated in conjunction with reciprocal rotation of a drive motor 5013 via driving force transmission gears 5011 and 5009. A carriage HC can mount a head unit, has a pin (not shown) which engages with a spiral groove 5005 of the lead screw 5004, and is reciprocally moved in an arrow a and an arrow b direction when the lead screw 5004 is rotated. A head unit 400 is mounted on this carriage HC.

The head unit will be described.

Figure 1B:
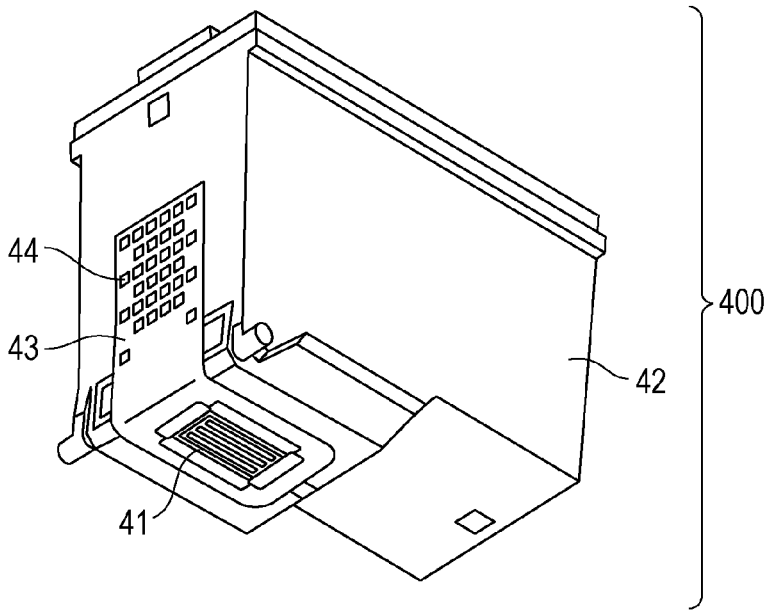
FIG. 1B is a schematic perspective view of a head unit.

FIG. 1B is a perspective view of the head unit 400 which can be mounted in the liquid discharge apparatus as shown in FIG. 1A. By a flexible film wiring substrate 43, a liquid discharge head 41 (hereinafter also referred to as "head") is electrically connected to contact pads 44 which are to be connected to the liquid discharge apparatus. In addition, the head 41 is integrated with an ink tank 42 to form the head unit 400. Although the head unit 400 of this embodiment shown by way of example is integrally formed from the ink tank 42 and the head 41, a separable type head unit from which an ink tank can be separated may also be used.

Figure 2A:
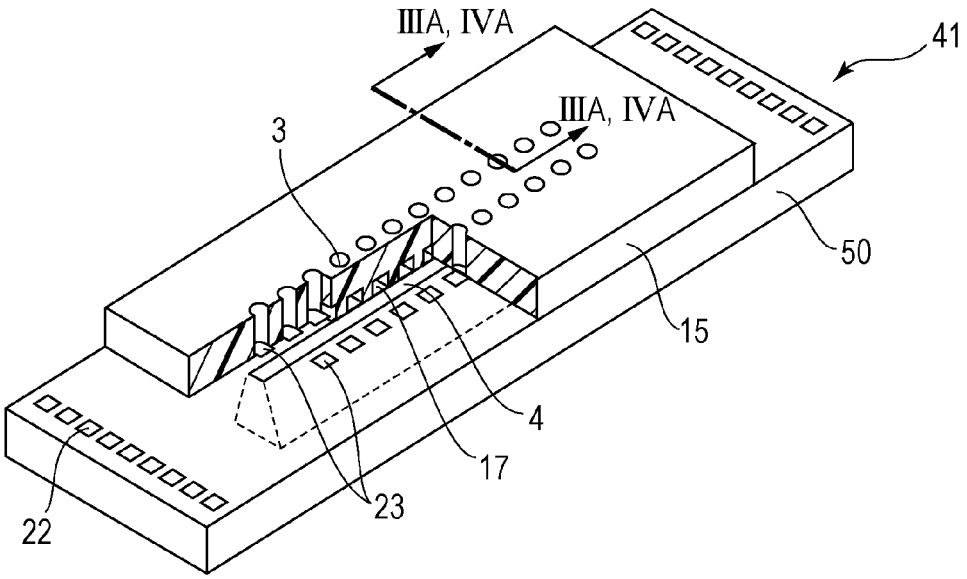
FIG. 2A is a schematic perspective view of a liquid discharge head according to the present invention.
Figure 2B:
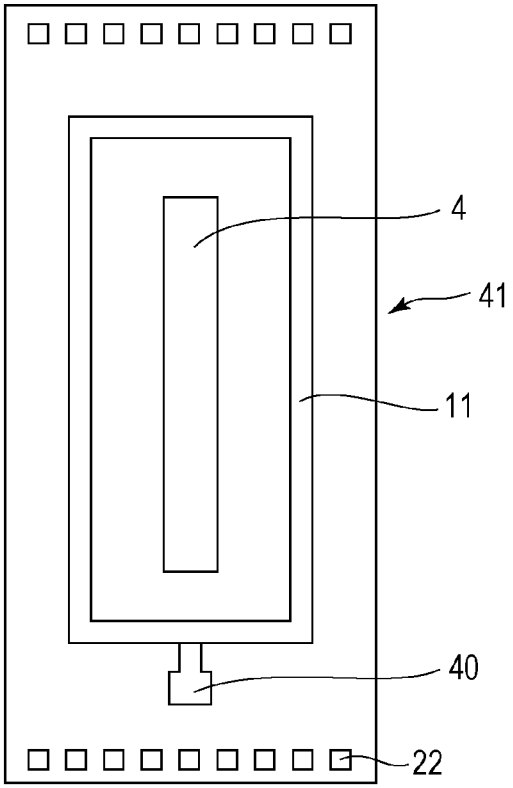
FIG. 2B is a schematic top view of the liquid discharge head according to the present invention.

FIG. 2A is a perspective view of the liquid discharge head 41 according to this embodiment. The liquid discharge head 41 has a liquid discharge-head substrate 50 including energy generating elements 23 which generate thermal energy used to discharge a liquid and a flow path wall member 15 provided on the liquid discharge-head substrate 50. The flow path wall member 15 can be formed using a cured material of a thermosetting resin, such as an epoxy resin, and has discharge ports 3 to discharge a liquid and walls 17*a* of flow paths 17 communicating with the respective discharge ports 3. When the flow path wall member 15 is brought into contact with the liquid discharge-head substrate 50 so that the walls 17*a* are located inside, the flow paths 17 are formed. The discharge ports 3 formed in the flow path wall member 15 are provided with predetermined pitches to form lines along a supply port 4 provided to penetrate the liquid discharge-head substrate 50. A liquid supplied from the supply port 4 is transported to the flow paths 17 and is further film-boiled by thermal energy generated by the energy generating elements 23, so that air bubbles are generated. Since the liquid is discharged from the discharge port 3 by the pressure generated at this time, a recording operation is performed. Furthermore, the liquid discharge head 41 has a plurality of terminals 22 used for electrical connection, and for example, logic signals for controlling driver elements 20 and the VH potential/ground potential (GND potential) for driving the energy generating elements 23 are sent to the terminals 22 from the liquid discharge apparatus. In addition, in order to drive the energy generating element 23, a voltage must be applied so that the potential difference between the two ends of the energy generating element 23 is 10 to 40 V. FIG. 2B is a schematic top view of the liquid discharge head 41 in which a metal layer 11 commonly covers the energy generating elements 23. An inspection terminal 40 used for inspection performed in manufacturing is connected to the metal layer 11. When electrical connection between the metal layer and the energy generating elements 23 is confirmed using the inspection terminal 40, it can be simultaneously confirmed that the insulating layer has no insulating defects.

Figure 3A:
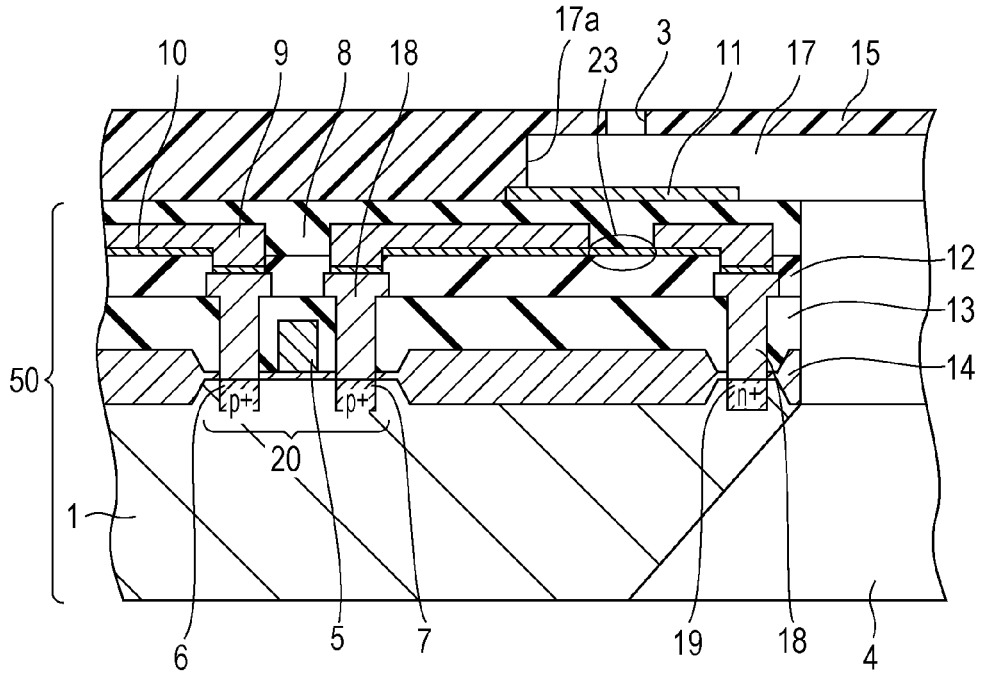
FIG. 3A is a cross-sectional view of the liquid discharge head according to the present invention.

FIG. 3A is a cross-sectional view schematically showing the state of the liquid discharge head 41 taken in the direction perpendicular to the substrate 50 along the line IIIA-IIIA of FIG. 2A. On a substrate 1 of silicon in which the driver element 20, such as a transistor, is provided, a thermal oxidation layer 14 formed by thermal oxidation of part of the substrate 1, a first heat storage layer 13, and a second heat storage layer 12, are provided, the two heat storage layers each being formed of a silicon compound using a CVD method or the like. As the first heat storage layer 13 and the second heat storage layer 12, in particular, for example, insulating materials, such as SiO, SiN, SiON, SiOC, and SiCN, may be used. The first heat storage layer 13 and the second heat storage layer 12 each also function as an insulating layer which insulates the electrode. On the second heat storage layer 12, a heat generating resistive layer 10 of a material which generates heat by electrical power supply is provided, and a pair of electrodes 9 of a material primarily composed of aluminum or the like having a low resistance as compared to that of the heat generating resistive layer 10 is provided so as to be in contact therewith. As the material for the heat generating resistive layer, in particular, for example, TaSiN or WSiN may be used. A first voltage and a second voltage are applied to the pair of electrodes 9 to enable a portion of the heat generating resistive layer 10 located therebetween to generate heat by electrical power supply, so that the above portion of the heat generating resistive layer 10 is used as the energy generating element 23. These heat generating resistive layers 10 and the pair of electrodes 9 are covered with an insulating layer 8 of an insulating material, such as a silicon compound, SiN or the like, so as to be insulated from the liquid to be discharged. In order to protect the energy generating element 23 from the cavitation impact or the like caused by foaming and shrinkage of the liquid to be discharged, the metal layer 11 used as a cavitation resistant layer is provided on the insulating layer 8 at a position corresponding to the upper portion of the energy generating element 23. That is, the metal layer 11 is provided at the position which faces the energy generating element 23.

In particular, a metal material, such as iridium or ruthenium, may be used as the metal layer 11. Furthermore, the flow path wall member 15 is provided on the insulating layer 8. In addition, in order to improve the adhesion between the insulating layer 8 and the flow path wall member 15, an adhesion layer formed of a polyether amide resin or the like may also be provided between the insulating layer 8 and the flow path wall member 15.

Even if no defects are detected in outgoing inspection performed using the inspection terminal 40, when a hole is formed in the insulating layer corresponding to one energy generating element, for example, by the influence of cavitation generated in a recording operation, the metal layer and the energy generating element may be short-circuited in some cases. In this case, when the energy generating element is driven at a high potential with respect to that of the liquid in the flow path, a metal material, such as iridium or ruthenium, has the same potential as that of the energy generating element when short circuit occurs. Therefore, as apparent from a potential-pH diagram shown in FIG. 6A or 6B, when functioning as an anode with respect to the liquid in the flow path, the metal material may be dissolved out with high probability. That is, in the structure in which a plurality of energy generating elements is commonly covered with a belt-shaped metal layer, when one energy generating element is once short-circuited, the whole metal layer covering the other energy generating elements is dissolved out.

Figure 6A:
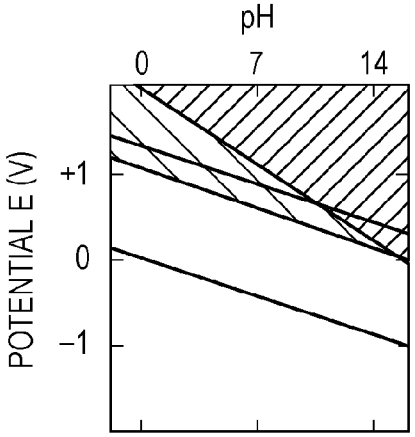
FIG. 6A is a potential-pH diagram of iridium.
Figure 6B:
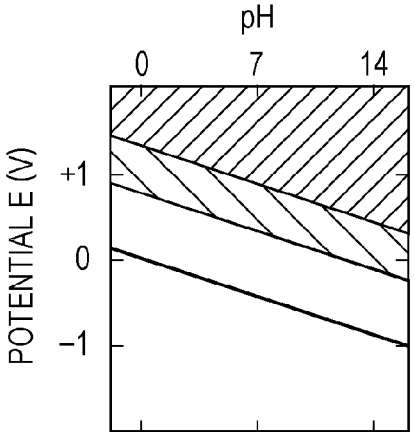
FIG. 6B is a potential-pH diagram of ruthenium.
Figure 6B:
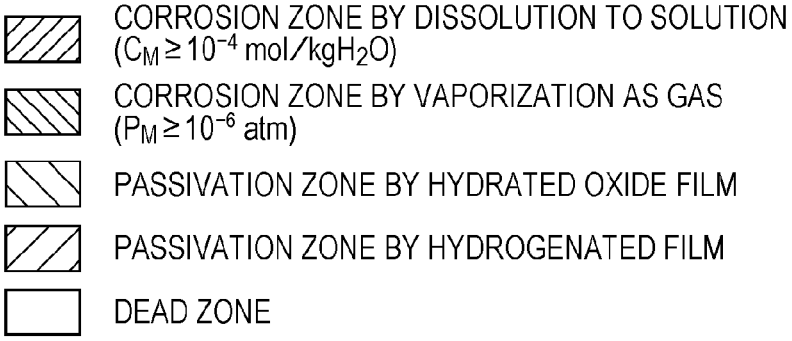

On the other hand, it is also found from FIGS. 6A and 6B that when the energy generating element is driven at a low potential with respect to that of the liquid in the flow path, even if a metal material, such as iridium or ruthenium, is at the same potential as that of the energy generating element, the probability in that the metal material is dissolved out is low regardless of the pH value of the liquid. Accordingly, when a crack or the like is generated in the insulating layer 8, since the metal layer 11 is at a low potential (second potential) when the potential (first potential) of the liquid is regarded as a reference potential, the dissolution of the metal layer 11 can be prevented. When the liquid discharge head is driven as described above, a normal recording operation can be performed without degrading the durability of the metal layer 11. Hereinafter, in particular, a liquid discharge head in which the metal layer 11 is not dissolved out and a method for driving this liquid discharge head will be described.

In the liquid discharge head of this embodiment, as the driver element 20, a p-type MOS transistor (hereinafter also referred to as "PMOST") is used, and an n-type silicon substrate is used as the substrate 1. A cross-sectional view of the liquid discharge head 41 of this embodiment taken in the direction perpendicular to the substrate 50 along the line IIIA-IIIA of FIG. 2A is shown in FIG. 3A, and a schematic circuit diagram is shown in FIG. 3B.

The driver element 20 is formed using a general IC manufacturing process and is formed from a gate electrode 5 provided on the n-type silicon substrate 1 with the thermal oxidation layer 14 provided therebetween, a drain electrode 6, and a source electrode 7, these two electrodes being formed in a p-type well region provided in the surface of the substrate 1. The gate electrode 5 is formed by providing polysilicon on the surface of the substrate 1, and the drain electrode 6 and the source electrode 7 are formed by ion implantation of boron or the like performed in the surface of the silicon substrate 1. The drain electrode 6 and the source electrode 7 are connected to a pair of electrodes 9 via electrodes 18 of aluminum or the like which are provided to penetrate the first heat storage layer 13.

In order to apply a voltage to the energy generating element 23, one of the pair of electrodes 9 is connected to the GND potential and is also connected to a connection portion 19 in an n-type well region provided by ion implantation of phosphorus or the like performed in the substrate 1 via the electrode 18. Accordingly, the substrate 1 is at the GND potential, and furthermore, since the liquid in the liquid path 17 is also in contact with the supply port 4 of the substrate 1, the liquid is also at the GND potential. In addition, when the other one of the pair of electrodes 9 is connected to a power supply potential (VH potential) of −40 to −10 V, which is lower than the GND potential, the potential difference between the GND potential and the VH potential is set to 10 to 40 V, and hence, the energy generating element 23 can be driven using a low potential as compared to the GND potential. Hence, even if a short circuit occurs between the energy generating element 23 and the metal layer 11 in the above case, the dissolution of the metal layer 11 covering the other energy generating elements can be prevented, and the generation of air bubbles concomitant with the dissolution of the metal layer 11 can be prevented, so that a reliable recording operation can be continuously performed.

Figure 3B:
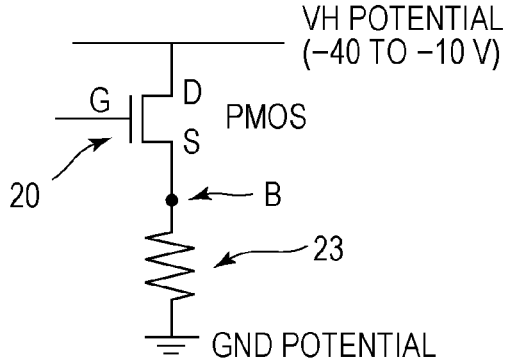
FIG. 3B is a circuit diagram of the liquid discharge head according to the present invention.

As shown in FIG. 3B, the drain electrode 6 is connected to a power supply from the liquid discharge apparatus via the terminal 22 so as to have a potential of −40 to −10 V as the VH potential, and the source electrode 7 is connected to the GND potential via the energy generating element 23. In addition, the drive signal which determines whether to drive the energy generating element 23 or not is generated in a logic circuit (not shown) based on a logic signal inputted from the terminal 22. By applying a voltage in accordance with this drive signal to the gate electrode of the PMOST, the PMOST 20 is put in an ON state, and an electrical current flows in the energy generating element 23, so that a recording operation is performed.

Figure 5A:
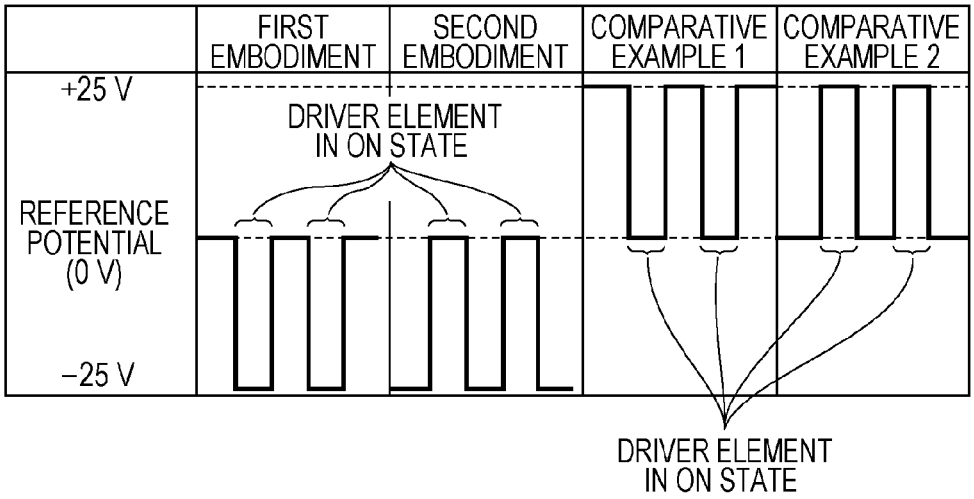
FIG. 5A is a view illustrating the relationship between the potential and dissolution of a metal layer.

FIG. 5A is a view showing the potential at a point B of the circuit diagram shown in FIG. 3B. In this figure, the case in which a voltage of −25 V is applied between the VH potential and the GND potential is shown by way of example. When the driver element 20 is in an OFF state, the potential at the point B is substantially 0 volt of the GND potential, and when the driver element is in an ON state, the potential at the point B is −25 V of the VH potential. When having a negative potential with respect to that of the liquid in the flow path 17, iridium or ruthenium is not dissolved out. Hence, when driving is performed as described above, even if a short circuit occurs by generation of a crack or the like in the insulating layer 8, the dissolution of a metal used for the metal layer 11 can be prevented regardless of the ON/OFF state of the driver element 20.

Heretofore, the embodiment has been described in which between the VH potential and the GND potential, the driver element 20 and the energy generating element 23 are provided in series in this order. Next, an embodiment in which between the VH potential and the GND potential, the energy generating element 23 and the driver element 20 are provided in series in this order will be described.

Figure 4A:
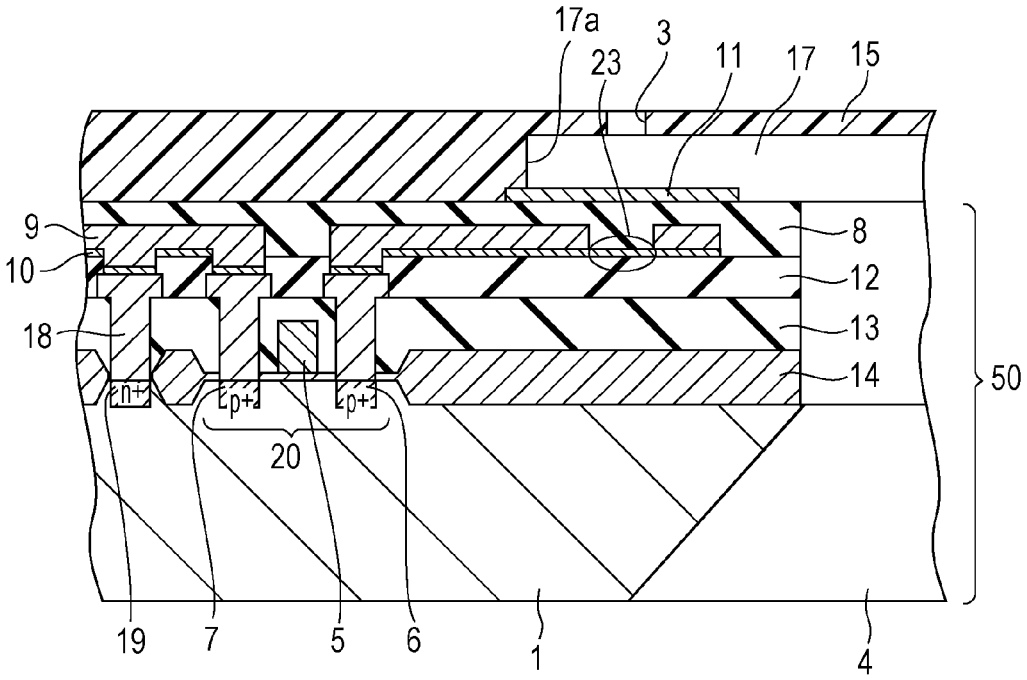
FIG. 4A is a cross-sectional view of a liquid discharge head according to the present invention.
Figure 4B:
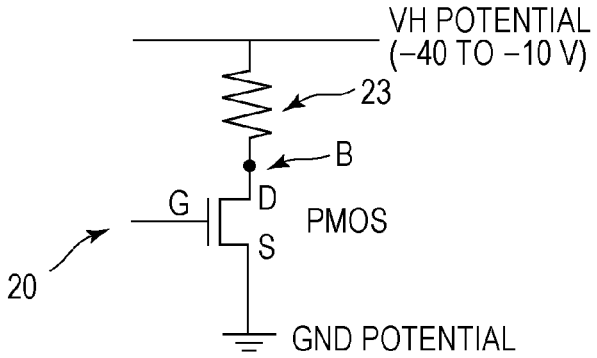
FIG. 4B is a circuit diagram of the liquid discharge head according to the present invention.

As the driver element 20, a p-type MOS transistor (hereinafter also referred to as "PMOST") is used, and an n-type silicon substrate is used as the substrate 1. A cross-sectional view of the liquid discharge head 41 of this embodiment taken in the direction perpendicular to the substrate 50 along the line IVA-IVA of FIG. 2A is shown in FIG. 4A, and a schematic circuit diagram is shown in FIG. 4B. The structure of the driver element 20 is approximately similar to that of the embodiment described above.

The drain electrode 6 and the source electrode 7 of the driver element 20 are connected to the pair of electrodes 9 for supplying a VH potential and a GND potential via the electrodes 18 of aluminum or the like which are provided to penetrate the first heat storage layer 13.

One of the pair of electrodes 9 for applying the VH potential and the GND potential to the energy generating element 23 which is connected to the GND potential is also connected to the connection portion 19 provided in the n-well region by ion implantation of phosphorus or the like performed in the substrate 1 via the electrode 18 and the driver element 20. Accordingly, the substrate 1 is at the GND potential, and the liquid in the flow path 17 is also at the GND potential since being in contact with the supply port 4 of the substrate 1; hence, when the energy generating element 23 is driven using a lower potential than the GND potential, the dissolution of the metal layer 11 can be prevented. That is, when the GND potential is regarded as a reference potential, a potential of −40 to −10 V lower than the GND potential is applied as the power supply potential (VH potential), so that the potential difference between the GND potential and the VH potential is set to 10 to 40 V. Hence, even if a short circuit occurs between the energy generating element 23 and the metal layer 11 in this case, the dissolution of the metal layer 11 which covers the other energy generating elements can be prevented, and the generation of air bubbles concomitant with the dissolution of the metal layer 11 can also be prevented, so that a reliable recording operation can be continuously performed.

As shown in FIG. 4B, one of the pair of electrodes 9 connected to the energy generating element is connected to a power supply from the liquid discharge apparatus via the terminal 22 so as to have a potential of −40 to −10 V as the VH potential, and the other one of the pair of electrodes 9 is connected to the drain electrode 6 of the driver element 20. In addition, the source electrode 7 of the driver element 20 is connected to the GND potential. The drive signal which determines whether to drive the energy generating element 23 or not is generated in a logic circuit (not shown) based on a logic signal inputted via the terminal 22. By applying a voltage in accordance with this drive signal to the gate electrode of the PMOST, the PMOST 20 is put in an ON state, the power supply voltage is applied to the energy generating element 23, and an electrical current flows, so that a recording operation is performed.

FIG. 5A is a view showing the potential at the point B of the circuit diagram shown in FIG. 4B. In this embodiment, the case in which a voltage of −25 V is applied between the VH potential and the GND potential is shown by way of example. When the driver element 20 is in an OFF state, the potential at the point B is −25 V since no current flows. In addition, when the driver element is in an ON state, since a current flows in the energy generating element 23, the voltage drop occurs, and hence the potential at the point B becomes substantially 0 V of the GND potential. When having a negative potential with respect to that of the liquid in the flow path 17, iridium or ruthenium is not dissolved out. Hence, when driving is performed as described above, even if a short circuit occurs by generation of a crack or the like in the insulating layer 8, the dissolution of a metal used for the metal layer 11 can be prevented regardless of the ON/OFF state of the driver element 20.

Comparative Example 1

As Comparative example 1, the case will be described in which an n-type MOS transistor (hereinafter also referred to as "NMOST") is provided in a p-type silicon substrate, and the voltage is applied so that the VH potential is +10 to +40 V. As shown in a circuit diagram of FIG. 5B, one of electrodes connected to the energy generating element 23 is at a VH potential of +10 to +40 V, and the other electrode is provided so as to be connected to a drain electrode of the NMOST. Furthermore, a source electrode of the NMOST is connected to the GND potential. Also in Comparative example 1, a liquid in the flow path 17 is provided in contact with a supply port and is hence at the GND potential. When the voltage is applied to a gate electrode of the NMOST, the NMOST is put in an ON state, and an electrical current flows in the energy generating element 23.

Figure 5B:
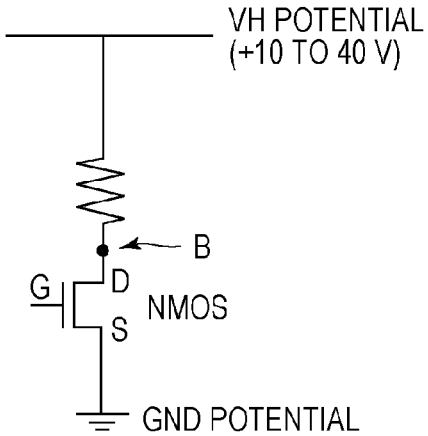
FIG. 5B is a circuit diagram of a liquid discharge head.

FIG. 5A shows the potential at a point B of the circuit diagram shown in FIG. 5B. In this comparative example, the case in which the voltage is applied so that the VH potential is 25 V will be described. Since no electrical current flows when the driver element 20 is in an OFF state, the potential at the point B is 25 V. When the driver element 20 is in an ON state, since an electrical current flows in the energy generating element 23, the voltage drop occurs, and the potential at the point B is substantially 0 V of the GND potential. Therefore, even if only one crack is generated in the insulating layer 8 covering the energy generating elements, when the driver element 20 is in an OFF state, and the metal layer 11 formed of iridium or ruthenium comes into contact with a liquid having a pH of approximately 7 to 10, the whole metal layer 11 functions as an anode. As a result, the portion of the metal layer covering the other energy generating elements will also be dissolved in the liquid. Furthermore, since air bubbles generated when the metal layer is dissolved cover the surfaces of the other energy generating elements 23, film boiling of the liquid cannot be performed, and hence, a normal recording operation cannot be performed.

Comparative Example 2

As Comparative example 2, the case in which an NMOST is provided as in Comparative example 1 will be described. As shown in a circuit diagram of FIG. 5C, one of a pair of electrodes connected to the energy generating element is connected via the NMOST to the terminal 22 to apply a potential of +10 to +40 V as the VH potential, and the other electrode is connected to the GND potential. Also in Comparative example 2, a liquid in the flow path 17 is provided in contact with a supply port and is hence at the GND potential.

Figure 5C:
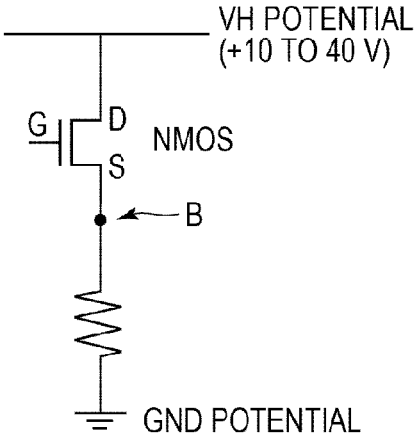
FIG. 5C is a circuit diagram of a liquid discharge head.

FIG. 5A shows the potential at a point B of the circuit diagram of FIG. 5C. In this comparative example, the case in which as the VH potential, a voltage of +25 V is applied is shown by way of example. When the driver element 20 is in an OFF state, the potential at the point B is 0 V. When the driver element 20 is in an ON state, the potential at the point B is +25 V of the VH potential.

Therefore, even if only one crack or the like is generated in the insulating layer 8 covering the energy generating elements, when the driver element 20 is in an ON state, and the metal layer 11 formed of iridium or ruthenium comes into contact with a liquid having a pH of approximately 7 to 10, the whole metal layer 11 functions as an anode. As a result, the portion of the metal layer covering the other energy generating elements will also be dissolved in the liquid. Furthermore, since air bubbles generated when the metal layer is dissolved cover the surfaces of the other energy generating elements 23, film boiling of the liquid cannot be performed, and hence, a normal recording operation cannot be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-275138, filed Dec. 9, 2010, which is hereby incorporated by reference herein in its entirety.

The invention claimed is:

1. A liquid discharge apparatus comprising:

a liquid discharge head which includes;

a discharge port to discharge a liquid; and a substrate including:

an energy generating element for generating thermal energy to discharge the liquid from the liquid discharge port;

a pair of electrodes connected to the energy generating element for driving thereof;

an insulating layer of an insulating material provided to cover the energy generating element; and a metal layer of a metal material provided corresponding to the energy generating element to cover the insulating layer, the metal material containing iridium or ruthenium as a primary component; and a driver unit which sets a first potential of one of the pair of electrodes substantially equal to the potential of the liquid and a second potential of the other one of the pair of electrodes lower than the first potential to drive the energy generating element at a potential that is lower than the potential of the liquid.

2. The liquid discharge apparatus according to claim 1, wherein the liquid discharge head is used to supply the liquid to the discharge port and has a supply port provided so as to penetrate the substrate.

3. The liquid discharge apparatus according to claim 1, wherein the first potential is a ground potential, and the second potential is a potential of −40 to −10 V based on the ground potential.

4. The liquid discharge apparatus according to claim 1, wherein the liquid discharge head has a driver element used to control an ON/OFF state which determines whether to supply an electrical power to the energy generating element or not.

5. The liquid discharge apparatus according to claim 4, wherein the substrate is an n-type silicon substrate, and the driver element comprises a p-type MOS transistor.

6. A liquid discharge head comprising:

a discharge port to discharge a liquid; and a substrate including:

an energy generating element for generating thermal energy to discharge the liquid from the liquid discharge port;

a pair of electrodes which is connected to the energy generating element for driving thereof, the electrodes being respectively placed at a first potential substantially equal to the potential of the liquid and a second potential lower than the first potential, such that the energy generating element is driven at a potential that is lower than the potential of the liquid;

an insulating layer of an insulating material provided to cover the energy generating element; and a metal layer of a metal material provided corresponding to the energy generating element to cover the insulating layer, the metal material containing iridium or ruthenium as a primary component.

7. The liquid discharge head according to claim 6, further comprising:

a driver element used to control an ON/OFF state which determines whether to supply an electrical power to the energy generating element or not.

8. The liquid discharge head according to claim 7, wherein the substrate is an n-type silicon substrate, and the driver element comprises a p-type MOS transistor.

9. A method for driving a liquid discharge head which has a liquid discharge port to discharge a liquid and a substrate which includes an energy generating element used to generate thermal energy to discharge the liquid from the discharge port, a pair of electrodes connected to the energy generating element for driving thereof, an insulating layer of an insulating material provided to cover the energy generating element, and a metal layer of a metal material provided corresponding to the energy generating element to cover the insulating layer, the metal material containing iridium or ruthenium as a primary component, the method comprising:

setting a first potential of one of the pair of electrodes substantially equal to the potential of the liquid and a second potential of the other one of the pair of electrodes lower than the first potential to drive the energy generating element at a potential that is lower than the potential of the liquid.

* * * * *